US009121131B2

(12) United States Patent
Underwood et al.

(10) Patent No.: US 9,121,131 B2
(45) Date of Patent: Sep. 1, 2015

(54) NON-COATED FABRIC FOR OUTDOOR APPLICATIONS

(71) Applicant: Safety Components Fabric Technologies, Inc., Greenville, SC (US)

(72) Inventors: Joey K. Underwood, Greenville, SC (US); Jacques Cantin, Greenville, SC (US)

( * ) Notice: Subject to any disclaimer, the term of this patent is extended or adjusted under 35 U.S.C. 154(b) by 0 days.

(21) Appl. No.: 14/153,633

(22) Filed: Jan. 13, 2014

(65) Prior Publication Data

US 2014/0127401 A1 May 8, 2014

Related U.S. Application Data

(60) Division of application No. 12/861,399, filed on Aug. 23, 2010, now abandoned, which is a continuation of application No. 11/035,050, filed on Jan. 13, 2005, now abandoned.

(51) Int. Cl.

| | |
|---|---|
| ***D06M 15/19*** | (2006.01) |
| ***D03D 1/00*** | (2006.01) |
| ***D06M 15/277*** | (2006.01) |
| ***D06N 3/04*** | (2006.01) |

(52) U.S. Cl.

CPC ..... *D06M 15/19* (2013.01); *D03D 1/00* (2013.01); *D03D 1/0041* (2013.01); *D06M 15/277* (2013.01); *D06N 3/047* (2013.01); *D06N 2209/067* (2013.01); *D06N 2209/105* (2013.01); *D06N 2209/121* (2013.01); *D06N 2209/1628* (2013.01); *D06N 2209/1678* (2013.01); *D10B 2505/18* (2013.01); *Y10T 442/2139* (2015.04); *Y10T 442/2164* (2015.04); *Y10T 442/2189* (2015.04); *Y10T 442/2221* (2015.04); *Y10T 442/2238* (2015.04); *Y10T 442/2631* (2015.04); *Y10T 442/3065* (2015.04)

(58) Field of Classification Search

None

See application file for complete search history.

(56) References Cited

U.S. PATENT DOCUMENTS

| | | | | |
|---|---|---|---|---|
| 3,365,329 | A | 1/1968 | Mackenzie, Jr. et al. | |
| 6,092,563 | A | 7/2000 | Swers et al. | |
| 6,557,590 | B2 | 5/2003 | Swers et al. | |
| 6,750,162 | B2 | 6/2004 | Underwood et al. | |
| 7,049,252 | B2 | 5/2006 | Underwood et al. | |
| 2003/0104134 | A1 | 6/2003 | Linford et al. | |
| 2003/0116744 | A1 | 6/2003 | Kimbrell | |
| 2004/0077238 | A1 | 4/2004 | Audenaert et al. | |
| 2004/0128770 | A1 | 7/2004 | Copeland et al. | |
| 2004/0152381 | A1* | 8/2004 | York et al. | 442/76 |
| 2004/0234718 | A1* | 11/2004 | Hawes | 428/57 |
| 2004/0242098 | A1* | 12/2004 | Bass | 442/59 |
| 2005/0014433 | A1 | 1/2005 | Langley et al. | |

OTHER PUBLICATIONS

Product Infomation: Sunbrella® The official website of Glen Raven, Inc. www.sunbrella.com/usa.

ASTM International Annual Book of ASTM Standards, vol. 07.01, *Standard Test Method for Thickness of Textile Materials*, West Conshohocken, PA, Apr. 1996.

ASTM International Annual Book of ASTM Standards, vol. 07.01, *Standard Test Method for Air Permeability of Textile Fabrics*, West Conshohocken, PA, Apr. 1996.

ASTM International Annual Book of ASTM Standards, vol. 07.01, *Standard Test Method for Stiffness of Fabric by the Circular Bend Procedure*, West Conshohocken, PA, Apr. 1994.

ASTM International Annual Book of ASTM Standards, vol. 07.01, *Standard Test Method for Breaking Strength and Elongation of Textile Fabrics* (*Grab Test*), West Conshohocken, PA, Jul. 1995.

ASTM International Annual Book of ASTM Standards, vol. 07.01, *Standard Test Method for Tearing Strength of Fabrics by the Tongue* (*Single Rip*), *Procedure* (*Constant Rate of Extension Tensile Testing Machine*, West Conshohocken, PA, Apr. 1996.

ASTM International Annual Book of ASTM Standards, vol. 07.01, *Standard Guide for Abrasion Resistance of Textile Fabrics* (*Rotary Platform, Double-Head Method*), West Conshohocken, PA, Nov. 2001.

AATCC Technical Manual, *Water Repellency: Spray Test*, 1999.

AATCC Technicaly Manual, *Water Resistance: Hydrostatic Pressure Test*, 1999.

AATCC Technicaly Manual, *Colorfastness to Light*, 2005.

SAE Standard, *Accelerated Exposure of Automotive Exterior Materials Using a Controlled Irradiance Water-Cooled Xenon ARC Apparatus*, SAE J1960, Jun. 1989.

NFPA 701, *Standard Methods of Fire Tests for Flame Propagation of Textiles and Films*, 1999.

Glo-Tex Chemicals, Inc. GLO-TARD DSF Material Safety Data Sheet, Jun. 1, 2004.

Glo-Tex Chemicals, Inc., GLO-CRYL AWX-3 Material Safety Data Sheet, Dec. 3, 2003.

* cited by examiner

*Primary Examiner* — Erma Cameron

(74) *Attorney, Agent, or Firm* — Dority & Manning, P.A.

(57) ABSTRACT

A non-coated fabric for outdoor applications is provided that is made up of a woven fabric and a chemical composition applied to the woven fabric. The woven fabric is made from multifilament yarns that are solution dyed and have a UV rating of at least 500 hours. The chemical composition is applied to the woven fabric and incorporated into the fabric such that the fabric has a hydrostatic pressure of at least 45 cm.

18 Claims, No Drawings

NON-COATED FABRIC FOR OUTDOOR APPLICATIONS

CROSS-REFERENCE TO RELATED APPLICATIONS

This application is a divisional application of U.S. patent application Ser. No.: 12/861,399 filed on Aug. 23, 2010, which is now abandoned and based on and claims priority to U.S. patent application Ser. No.: 11/035,050 having a filing date of Jan. 13, 2005, which is also now abandoned, and wherein both applications are incorporated by reference herein in their entirety.

FIELD

The present disclosure generally relates to fabrics for outdoor applications. More particularly, the present disclosure is directed to non-coated fabrics having improved properties including improved hydrostatic pressure and UV resistance properties.

BACKGROUND

Fabrics that are appropriate for use in outdoor applications must be durable and must be able to withstand weather conditions and other harsh conditions to which they are often subjected. In designing a fabric for use in outdoor applications, it is important to look at factors including hydrostatic pressure and UV resistance properties. In addition, factors such as appearance, breathability, dimensional stability, abrasion resistance, mark off resistance, and ease of fabrication are also very important. Environmental considerations are important as well.

In the past, the water resistant properties of fabrics used in outdoor applications were improved primarily by utilizing various coatings on the fabric. However, coated fabrics are not breathable. In addition, heavy coating on one side of the fabric causes water vapors to be trapped on the uncoated side of the fabric leading to the formation of mildew. Coated fabrics also lack the appearance of and are more costly to produce than non-coated fabrics.

While more breathable, existing non-coated fabrics have high mark off, poor abrasion resistance, and poor dimensional stability. In addition, current non-coated fabrics have poor hydrostatic pressure or poor UV resistance. Thus, a need exists for non-coated fabrics for use in outdoor applications that have improved air permeability, improved mark off, improved abrasion resistance, and improved dimensional stability. In addition, a need exists for non-coated fabrics having improved hydrostatic pressure and improved UV resistance.

SUMMARY

The present disclosure recognizes and addresses the foregoing needs and others in the field of fabrics.

The present disclosure is directed toward a non-coated fabric for outdoor applications that is made up of a woven fabric and a chemical composition applied to the woven fabric. The woven fabric is made from multifilament yarns that are solution dyed and have a UV rating of at least 500 hours. The chemical composition is applied to the woven fabric and incorporated into the fabric such that the fabric has a hydrostatic pressure of at least 45 cm.

In certain embodiments, the multifilament yarns may comprise polyester. In some embodiments, the multifilament yarns are chosen from the group consisting of nylon, polypropylene, polyethylene, polytetrafluoroethylene, and mixtures thereof. In some embodiments, the woven fabric has a hydrostatic pressure of at least 55 cm or at least 65 cm. In certain embodiments, the woven fabric has a UV rating of at least 1000 hours or at least 1500 hours. In some embodiments, the woven fabric has a basis weight of from about 3 to about 10 ounces per square yard. In certain embodiments, the woven fabric has an ottoman weave. In some embodiments, the chemical composition comprises a fluorocarbon polymer composition. In certain embodiments, the fabric is used in the construction of an outdoor product chosen from the group consisting of awnings, casual outdoor furniture, umbrellas, covers, canopies, and banners.

In another exemplary embodiment, a non-coated woven fabric for outdoor applications is disclosed with a UV rating of at least 500 hours, a hydrostatic pressure of at least 45 cm, a grab strength of at least 400 lbs in the warp direction and 200 lbs in the fill direction, and a taber abrasion of at least 300 cycles to first hole.

Definitions and Standaridized Procedures

The following definitions and procedures are offered in order to better describe and quantify the performance fabrics made according to the present disclosure.

Thickness Test

The thickness test measures the thickness of the fabric. The test is known in the art and conforms to ASTM D 1777-96 (Reapproved 2002). The results are expressed in millimeters.

A fabric is placed on the base of a thickness gage and a weighted presser foot is lowered. The displacement between the base and the presser foot is measured as the thickness of the fabric.

Water Repellency: Spray Test

The spray rating test measures the resistance of fabrics to wetting by water. The test is known in the art and conforms to AATCC 22-1996. The results are expressed on a scale of 0 to 100 with 0 indicating a complete wetting of whole upper and lower surfaces and 100 indicating no sticking or wetting of the upper surface.

Water sprayed against the taut surface of a test specimen under controlled conditions produces a wetted pattern whose size depends on the relative repellency of the fabric. Evaluation is accomplished by comparing the wetted pattern with pictures on a standard chart.

Air Permeability

Air permeability can be used to provide an indication of the breathability of weather resistant and rainproof fabrics. The air permeability test is known in the art and conforms to ASTM D 737-96. The results are expressed in cubic feet/square feet minute (cfm).

The rate of air flow passing perpendicularly through a known area of fabric is adjusted to obtain a prescribed air pressure differential between the two fabric surfaces. From this rate of air flow, the air permeability is determined.

Water Resistance: Hydrostatic Pressure Test

The hydrostatic pressure test measures the resistance of a fabric to the penetration of water under hydrostatic pressure. The test is known in the art and conforms to AATC 127-1998. The results are expressed in cm H2O.

One surface of the test specimen is subjected to a hydrostatic pressure, increasing at a constant rate, until three points of leakage appear on its other surface. The water may be applied from above or below the test specimen.

Stiffness of Fabric by the Circular Bend Procedure

The circular bend procedure gives a force value related to fabric stiffness, simultaneously averaging stiffness in all directions. The test is known in the art and conforms to ASTM D 4032-94 (Reapproved 2001).

A plunger forces a flat, folded swatch of fabric through an orifice in a platform. The maximum force required to push the fabric through the orifice is an indication of the fabric stiffness (resistance to bending).

Breaking Strength and Elongation of Textile Fabrics (Grab Test)

The grab tensile test used herein measures breaking strength of a fabric when subjected to unidirectional stress. This test is known in the art and conforms to ASTM D 5034-95 (Reapproved 2001). The results are expressed in pounds to break. Higher numbers indicate a stronger fabric. The values noted herein, measured in pounds, represent the "load" or the maximum load or force, expressed in units of weight, required to break or rupture the specimen in a tensile test.

The grab tensile test uses two clamps, each having two jaws with each jaw having a facing in contact with the fabric sample. The clamps hold the fabric in the same plane, usually vertically, separated by approximately three inches and move apart at a specified rate of extension. The sample is wider than the clamp jaws to give results representative of effective strength of yarns in the clamped width combined with additional strength contributed by adjacent yarns in the fabric. Usually, a grab tensile strength test closely simulates fabric stress conditions in actual use. Results are reported as an average of three specimens and may be performed with the specimen in the cross direction or the machine direction.

Tearing Strength of Fabrics by the Tongue (Single Rip) Procedure

Tear strength, as measured in this test method, requires that the tear be initiated before testing. The reported value obtained is not directly related to the force required to initiate or start of a tear. The test method used is known in the art and conforms to ASTM D 2261-96 (Reapproved 2002).

A rectangular specimen, cut in the center of a short edge to form a two-tongued (trouser shaped) specimen, in which one tongue of the specimen is gripped in the upper jaw and the other tongue is gripped in the lower jaw of a tensile testing machine. The separation of the jaws is continuously increased to apply a force to propagate the tear. At the same time, the force developed is recorded. The force to continue the tear is calculated from autographic chart recorders or microprocessor data collection systems.

Abrasion Resistance of Textile Fabrics (Rotary Platform, Double-Head Method)

The abrasion cycle is dependent on the programmed motions of the abrasion machine and the test standard used. It may consist of one back and forth unidirectional movement such as for the rotary platform test method. The test method used is known in the art and conforms to ASTM D 3884-01.

A specimen is abraded using rotary rubbing action under controlled conditions of pressure and abrasive action. The test specimen, mounted on a platform, turns on a vertical axis, against the sliding rotation of two abrading wheels. One abrading wheel rubs the specimen outward toward the periphery and the other, inward toward the center. The resulting abrasion marks form a pattern of crossed arcs overran area of approximately 30 $cm^2$.

Ultraviolet Rating Test

Two methods are used to determine ultraviolet rating. The accelerated exposure test is designed to accelerate extreme environmental conditions encountered due to sunlight, heat, and moisture for the purpose of predicting the performance of materials. The test method used is known in the art and conforms to SAE J1960 JUNE 89. The colorfastness to light test tests the resistance of a material to a change in its color characteristics as a result of exposure of the material to sunlight or an artificial light source. The test method used is known in the art and conforms to AATC Test Method 16-2004.

Flame Propagation Test

The flame propagation test is used to assess the propagation of flame beyond an area exposed to an ignition source. The test method used is known in the art and conforms to NFPA 701-1999 Edition.

A weighed specimen consisting of one or more layers of textile is suspended vertically from a pin bar near the top rear of an open-face test cabinet. A specified gas flame is applied to the center of the lower edge of the specimen for 45 seconds and then withdrawn. The specimen is allowed to burn until the flame self-extinguishes and there is no further specimen damage. The specimen is then removed from the pin bar and, after room conditioning, is weighed again. The percent weight loss is determined and used as a measure of total flame propagation and specimen damage.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

In general, the present disclosure is directed to a non-coated fabric suitable for outdoor applications that has significantly improved hydrostatic pressure and UV resistant properties. In addition, the non-coated fabric has improved air permeability, improved mark off, improved abrasion resistance, and improved dimensional stability. The non-coated fabric also protects from other outdoor elements such as visible light, infra-red heat, heat, organic particles, pollution residuals, bird droppings, etc.

The non-coated woven fabric of the present disclosure has improved characteristics over both coated and non-coated fabrics in the art. As used herein, a coated fabric refers to a fabric in which a thickness of polymer is applied on at least one side of the fabric. By contrast, a non-coated fabric refers to a fabric that is substantially impregnated with a treatment. In particular, the present disclosure is directed to a non-coated woven fabric made from multifilament yarns. The multifilament yarns provide greatly improved dimensional stability and abrasion resistance when compared to other non-coated fabrics. The multifilament yarns are solution dyed and enhanced with UV stabilizers so that the yarns and the fabric have greatly improved UV resistance when compared to other coated fabrics. In addition, a chemical composition is applied to the fabric which greatly improves the resistance of the fabric to the penetration of water under hydrostatic pressure without the mark off typical of both coated and non-coated fabrics. The chemical composition also improves air permeability over existing coated fabrics.

Fabrics that are suitable for use in the process of the present disclosure may be manufactured with yarns made of nylon, polyester, polypropylene, polytetrafluoroethylene, polyethylene, mixtures thereof, and other similar yarns. For most applications, however, polyester is preferred. In one exemplary embodiment, SATURA yarns are utilized which are commercially available from Unifi, Inc. The SATURA yarns are solution dyed with specialty pigments commercially available from American Colors. In addition, UV stabilizers are added to the yarns. In a solution dyed yarn, pigments and UV stabilizers are added while the yarn is still in a liquid state. The components become part of the fibers and resist fading or washing out. It has also been found that UV resistance can be greatly increased using such yarns. In some embodiments, the UV rating of the fabrics is at least 500 hours. In other embodiments, the UV rating of the fabrics is at least 1000 hours. And in still other embodiments, the UV rating of the fabrics is at least 1500 hours. High UV resistance characteristics in fabrics are important for color and strength retention.

The yarns used in the fabric of the present disclosure may be woven into various constructions. A particular weave may be selected to provide durability, stability, breathability, and ease of fabrication. For instance, it is preferable that the fabric of the present invention have an ottoman weave or a plain weave. Any other suitable weave may be employed, for example such as a ripstop weave or a twill weave. However, it is important the fabric maintain a balance of stiffness for ease of cutting and softness for ease of contouring on a particular outdoor product.

The weight of the fabric made in accordance with the present disclosure can vary and generally will depend upon the particular application for which the fabric is used. However, the fabric made in accordance with the present disclosure has improved characteristics over the prior art fabrics with a lower weight (ounce per yard). The fabric is designed to withstand inconsistent and repetitive loads with high dynamic forces like wind gusts, heavy rain, air pressure, etc. For most applications, the fabric can have a weight of from about 3 ounces per square yard to about 10 ounces per square yard, and particularly from about 5.5 ounces per square yard to about 8.5 ounces per square yard. In general, the yarns used to construct the fabric are multifilament yarns, although it is believed that monofilament yarns may be used in some applications. The denier of the yarns again will vary depending upon the type of product being formed with the fabric. In general, however, the denier of the yarns can be from about 150 to about 900. It may also be desirable to texturize multifilament yarns with air jet texturing or plying.

When using yarns within the above described denier ranges, the woven fabric of the present invention can have from about 30 ends to about 100 ends per inch, which refers to the warp yarn density. More particularly, the fabric can have from about 80 to about 100 ends per inch. The number of picks, which refers to the fill yarn density, on the other hand, can generally vary from about 40 picks per inch to about 80 picks per inch. In the fill direction, 76 picks per inch is preferable when using an ottoman weave while 50 picks per inch is preferable when a plain weave is utilized.

In accordance with the present disclosure, the exterior surface of the fabric includes a chemical composition. The chemical composition applied to the fabric in accordance with the present disclosure has been found to provide excellent water resistance capabilities. It was also discovered that the chemical composition significantly improves the breathability of the fabric when compared to coated fabrics. As discussed above, when applied according to the present disclosure, it has been discovered that the finish is very abrasion resistant. The fabric is also resistant to chemicals for ease of cleaning.

In one embodiment of the present disclosure, the chemical composition is made from a solution of a fluorocarbon polymer that is applied to the fabric. For example, the chemical composition can be made from GLO-CRYL AWX 3 which is commercially available from Glo-Tex Chemicals, Inc. Fluorocarbon polymer solutions are also commercially available from other numerous sources.

Besides containing a fluorocarbon polymer, the chemical composition can also contain various other additives. For instance, in one embodiment, the chemical composition can contain a fluorocarbon polymer, an antimicrobial, and a wetting agent such as isopropyl alcohol. The antimicrobial serves to help make the fabric mildew resistant.

In one embodiment, the finish composition can contain from about 1 percent to about 20 percent by weight of a fluorocarbon polymer composition, and particularly from about 2 percent to about 5 percent by weight of the bath. Further, the treatment can contain an antimicrobial and a wetting agent in an amount from about 0.1 percent to about 5 percent by weight, and particularly from about 0.1 percent to about 1 percent by weight of the bath.

In order to produce a liquid resistant fabric in accordance with the present disclosure, after the woven fabric is constructed, the fabric can first be scoured, although scouring may not be necessary for all applications. After scouring, the fabric will be dried.

After these processing steps, a chemical composition according the present disclosure is supplied to at least one side of the fabric. Although the treatment can be applied by plasma treatment, sprayed on the fabric, or printed on the fabric, preferably the fabric is dipped into a bath containing the chemical composition in solution form.

As stated above, the chemical composition in one embodiment, can be a solution containing a fluorocarbon polymer. The fluorocarbon polymer can be combined in the solution with water, a drying agent such as an alcohol, and an emulsifier. The amount of the water-resistant composition applied to the fabric will depend upon the particular formulation and the particular application.

In one embodiment, the composition is applied to the fabric at a wet pick up rate of from about 10% to about 50% by weight of the fabric, particularly from about 30% to about 35% by weight.

After the chemical composition is applied to the fabric, the fabric is then heated to a temperature sufficient for the finish to dry and/or cure. The fabric must be dimensionally stable to withstand heat during processes. In one particular embodiment, the finish may be cured by heating the fabric to a temperature of about 360° F. for approximately 20-25 seconds. In some embodiments, after curing the finish, the fabric is passed through a calender under at least 1000 psi to help reduce the mark off of the fabric. Once the chemical composition is cured and affixed to the woven fabric, the fabric can then be used in constructing materials for outdoor applications.

In one embodiment of the present disclosure, a flame retardant may also be applied to the fabric. The flame retardant can include GLO-TARD DSF which is commercially available from Glo-Tex Chemicals, Inc. However, any other suitable flame retardant compounds may also be utilized. The flame retardant compound serves to make the fabric fire resistant. A fire resistant fabric is noncombustible and non conductive and can be utilized where flammability is a concern.

As stated previously, the non-coated fabric of the present disclosure significantly improves hydrostatic pressure and UV resistance of fabrics. In addition, the non-coated fabric has improved air permeability, improved mark off, improved abrasion resistance, and improved dimensional stability. Such resistance is of great importance in fabrics for outdoor applications.

Preferred embodiments of the present invention involve the use of the fabric in the construction of materials for outdoor applications. Items that benefit from improved hydrostatic pressure and UV resistance may be constructed from the fabric described herein. For example, marine applications, awnings, casual outdoor furniture, umbrellas, covers, canopies, banners, and the like may be constructed using the fabric of the present invention.

The advantages of the present invention over coated fabrics in the prior art may be better understood with reference to the following Example 1:

| Name | Top Gun (coated) | Odyssey III (coated) | SurLast (coated) | Sample 1 (non-coated) | Sample 2 (non-coated) |
|---|---|---|---|---|---|
| Company | Marchem | Marchem | Glen Raven | Safety Components | Safety Components |
| Construction | 116 × 72 | 62 × 43 | 43 × 31 | 95 × 74 | 95 × 50 |
| Weave | 2 × 2 Basket | Plain | Plain | Ottoman | Plain |
| Weight (oz/yd) | 11.3 | 6.2 | 7.4 | 8.0 | 6.5 |
| Air Permeability | 0.02 | 0.05 | 0.11 | 1.30 | 1.40 |
| Hydrostatic Pressure (cm) | 83 | 20 | 59 | 65 | 50 |
| Grab Strength Warp (lb) | 621 | 302 | 410 | 490 | 460 |
| Grab Strength Filing (lb) | 414 | 226 | 286 | 390 | 270 |
| UV Rating | 1000 | 1000 | 600 | 1500 | 1500 |

The advantages of the present invention over non-coated fabrics in the prior art may be better understood with reference to the following Example 2:

| Name | Sunbrella (non-coated) | Sample 1 (non-coated) | Sample 2 (non-coated) |
|---|---|---|---|
| Company | Glen Raven | Safety Components | Safety Components |
| Construction | 77 × 36 | 95 × 74 | 95 × 50 |
| Weave | Plain | Ottoman | Plain |
| Weight (oz/yd) | 9.0 | 8.0 | 6.5 |
| Hydrostatic Pressure (cm) | 39 | 65 | 50 |
| Grab Strength Warp (lb) | 365 | 490 | 460 |
| Grab Strength Filing (lb) | 212 | 390 | 270 |
| Tongue Tear Strength Warp (lb) | 13 | 17 | 12 |
| Tongue Tear Strength Filing (lb) | 9 | 20 | 10 |
| Taber Abrasion (Cycles to 1st hole) | 90 | 600 | 400 |
| UV Rating | 1500 | 1500 | 1500 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed is:

1. A method for manufacturing a single-layer, non-coated fabric for outdoor applications, the method comprising:

providing a single-layer woven fabric, the woven fabric having an air permeability of at least 1 cfm, the woven fabric being made from multifilament yarns, the yarns being solution dyed with a solution containing a pigment and a UV stabilizer, the yarns having a UV rating of at least 500 hours;

applying a chemical composition to the woven fabric by dipping the woven fabric into a solution comprising the chemical composition, the chemical composition comprising a fluorocarbon polymer, wherein the chemical composition is incorporated into the woven fabric such that the woven fabric has a hydrostatic pressure of at least 45 cm;

after applying the chemical composition, heating the woven fabric to form the single-layer, non-coated fabric, wherein, after heating, the single-layer, non-coated fabric comprises an air permeability of at least 1 cfm; and incorporating the single-layer, non-coated fabric into an outdoor product without combining the single-layer, non-coated fabric with additional layers of material.

2. The method of claim 1, further comprising, before applying the chemical composition, scouring the single-layer woven fabric.

3. The method of claim 2, further comprising, after scouring the single-layer woven fabric, drying the single-layer woven fabric.

4. The method of claim 1, wherein the multifilament yarns comprise polyester.

5. The method of claim 1, wherein the single-layer woven fabric has a hydrostatic pressure of at least 55 cm.

6. The method of claim 1, wherein the yarns have UV rating of at least 1000 hours.

7. The method of claim 1, wherein the single-layer woven fabric has a basis weight of from about 3 to about 10 ounces per square yard.

8. The method of claim 1, wherein the single-layer woven fabric has one of an ottoman weave or a plain weave.

9. The method of claim 1, wherein the outdoor product is chosen from the group consisting of awnings, casual outdoor furniture, umbrellas, covers, canopies, or banners.

10. A method of manufacturing a single-layer, non-coated woven fabric for an outdoor product comprising an awning or an umbrella, the method comprising:

providing a single-layer woven fabric, the woven fabric having an air permeability of at least 1 cfm, the woven fabric being made from multifilament yarns, the yarns being solution dyed with a solution containing a pigment and a UV stabilizer, the yarns having a UV rating of at least 500 hours;

applying a chemical composition to the woven fabric by dipping the woven fabric into a solution comprising the chemical composition, the chemical composition comprising a fluorocarbon polymer, wherein the chemical composition is incorporated into the woven fabric such that the woven fabric has a hydrostatic pressure of at least 45 cm;

after applying the chemical composition, heating the woven fabric to form the single-layer, non-coated fabric, wherein, after heating, the single-layer, non-coated fabric comprises an air permeability of at least 1 cfm; and incorporating the single-layer, non-coated fabric with additional layers of material.

11. The method of claim 10, further comprising, before applying the chemical composition, scouring the single-layer woven fabric.

12. The method of claim 11, further comprising, after scouring the single-layer woven fabric, drying the single-layer woven fabric.

13. The method of claim 10, wherein the single-layer woven fabric has a hydrostatic pressure of at least 55 cm.

14. The method of claim 10, wherein the yarns have a UV rating of at least 1000 hours.

15. The method of claim 10, wherein the yarns have a UV rating of at least 1500 hours.

16. The method of claim 10, wherein the single-layer woven fabric has a basis weight of from about 5.5 to about 8.5 ounces per square yard.

17. The method of claim 10, wherein the single-layer woven fabric has one of an ottoman weave or a plain weave.

18. The method of claim 10, wherein the chemical composition further comprises an antimicrobial and a wetting agent.

* * * * *